United States Patent [19]

Roeder

[11] Patent Number: 4,495,958

[45] Date of Patent: Jan. 29, 1985

[54] MEDICATION DISPENSER

[76] Inventor: Malcholm O. Roeder, 414 E. Mill St., Danville, Ind. 46122

[21] Appl. No.: 468,388

[22] Filed: Feb. 22, 1983

[51] Int. Cl.[3] ..... A45D 24/26

[52] U.S. Cl. ..... 132/113; 119/83; 401/183; 401/204; 401/207

[58] Field of Search ..... 401/11, 25, 26, 42, 401/130, 138, 139, 140, 183, 185, 203, 204, 206, 207, 265, 266; 119/83, 85, 156; 132/79 B, 113, 114, 115

[56] References Cited

U.S. PATENT DOCUMENTS

| | | | |
|---|---|---|---|
| 1,232,005 | 7/1917 | Cottle | 132/113 |
| 1,574,418 | 2/1926 | Coviello | 132/113 X |
| 1,595,281 | 8/1926 | Anderson | 132/114 |
| 2,006,289 | 6/1935 | Andvig | 401/42 |
| 2,789,300 | 4/1957 | Beller | 401/140 |
| 2,877,810 | 3/1959 | Zackheim | 132/79 B |
| 2,934,314 | 4/1960 | Chambers et al. | 401/42 X |
| 4,126,401 | 11/1978 | Stoyshin | 401/42 |
| 4,236,840 | 12/1980 | Kennedy | 401/42 |

FOREIGN PATENT DOCUMENTS

| | | | |
|---|---|---|---|
| 1048202 | 12/1958 | Fed. Rep. of Germany | 401/183 |
| 2815722 | 10/1979 | Fed. Rep. of Germany | 401/138 |
| 576300 | 4/1958 | Italy | 132/113 |

*Primary Examiner*—Robert P. Swiatek

*Attorney, Agent, or Firm*—Barnes & Thornburg

[57] ABSTRACT

A medication dispenser has a medication container and a head removably coupled to the container to permit flow of medication from the container to the head and to permit recharging or replacement of the container or head. A medication passageway between the container and the head includes removable orifices for selectively regulating flow of medication from the container through the head. A plurality of teeth defining channels are provided on the head for the passage of medication from the head through the channels onto an animal. The head has a surface which is generally parallel to the surface of the animal, and the teeth extend from the head at an oblique angle to the surface.

24 Claims, 8 Drawing Figures

MEDICATION DISPENSER

The present invention relates to apparatus for dispensing or applying fluids to a surface covered by hair or fur. More particularly, the present invention relates to improvements in such apparatus which provide versatility and increased efficiency of operation.

Various fluid applicators and dispensers are well known in the art. There are, for example, the devices of U.S. Pat. Nos. 712,530; 2,647,490; 3,145,691; 3,267,903; 3,463,170; 3,626,546; 3,574,885; 3,961,635; 4,317,464; 4,044,724; 4,213,423; and 4,237,822.

According to one embodiment of the present invention, a dispenser for dispensing medication or the like onto animals includes a head, a medication container, means for removably coupling the head to the container to permit flow of medication or the like from the container to the head when the container is coupled to the head and to permit recharging or replacement of the container when it is removed from the head, means providing a removable orifice for selectively regulating flow of medication or the like from the container through the head, and a plurality of teeth which define channels for the passage of medication or the like from the head onto the animal.

In one embodiment, the head includes threads for removably coupling it to the container and separate passageways between the container and the channels. The orifice-providing means includes a removable orifice insert in each of the passageways and a somewhat cup-shaped member having a radially extending skirt or flange which engages the threads on the head. An orifice is provided in a surface of the cup-shaped member opposite the orifice inserts and includes a nipple for coupling the orifice to a flexible tube. An illustrative embodiment of the present invention also includes a weight on the end of the flexible tube for maintaining the end beneath the level of the medication or like in the container.

In an illustrative embodiment, the channels are generally rectangular in section transverse to the longitudinal extent of the teeth, with each channel having a length dimension extending generally in the direction of motion of the tooth, and a width dimension extending generally transverse to the direction of motion of the tooth. The head has a surface which is generally parallel to the surface of the animal across which the head is drawn in use, and the teeth extend from the head at an oblique angle to the surface. The teeth form a set with free ends which are contoured with the shorter teeth being toward the center of the set and the longer teeth being toward the ends of the set when viewed generally from the direction in which the head is drawn to form a somewhat "inverted-V" or "inverted-U" configuration.

According to another embodiment of the invention, the dispenser includes a handle, means for coupling the container to the handle, means for coupling the handle to the head, and means for defining a passageway through the handle for coupling the container to the head. The handle includes a hand-manipulable valve for selectively initiating and halting the flow of medication or the like through the passageway. The container may be a gravity feed tank or a pressurizable tank.

In a further embodiment according to the present invention, the handle includes means for defining a first passageway therethrough for water to be mixed with the medication and means defining a second passageway therethrough for coupling the container to the first passageway to dispense the medication in the container into the stream of water in the first passageway.

Various features and advantages of the present invention will become apparent in view of the following detailed description, which description should be considered in conjunction with the accompanying drawings, in which.

Figure 1:
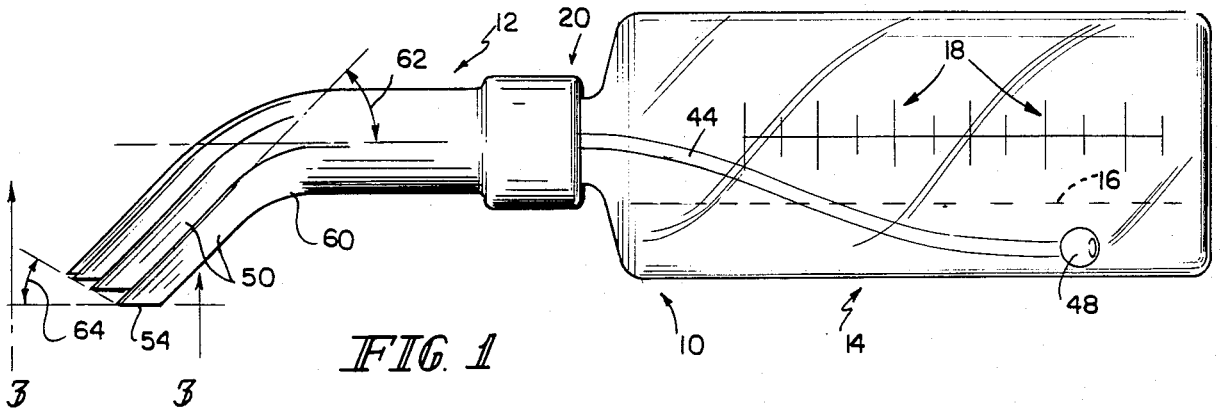
FIG. 1 is a side elevational view of a dispenser embodying the present invention.
Figure 3:
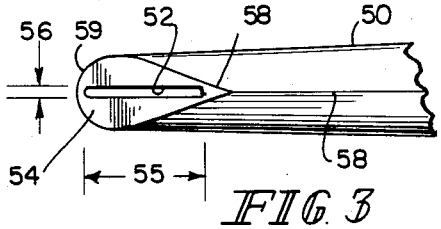
Figure 2:
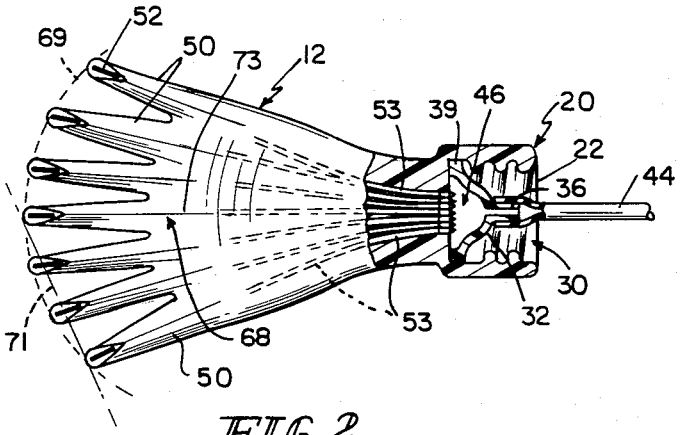
FIG. 2 is a bottom plan view, partly broken away, of a portion of the dispenser shown in FIG. 1.
Figure 2A:
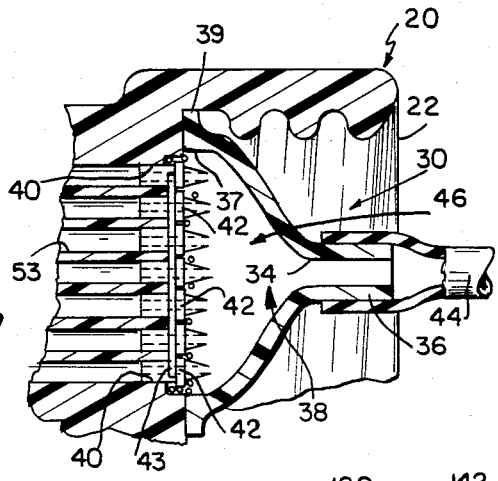
Figure 7:
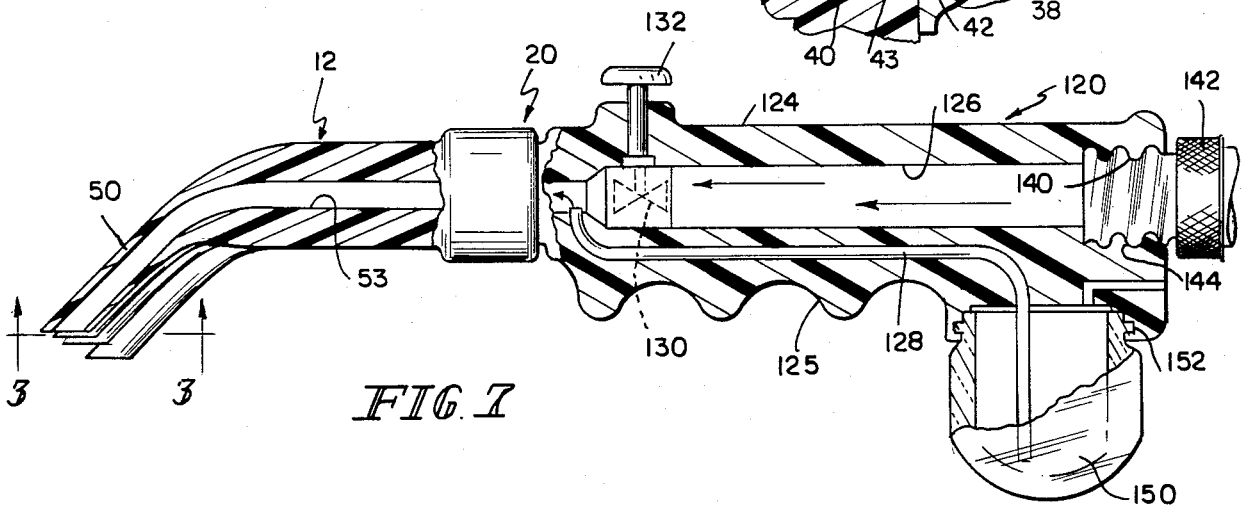
Figure 6:
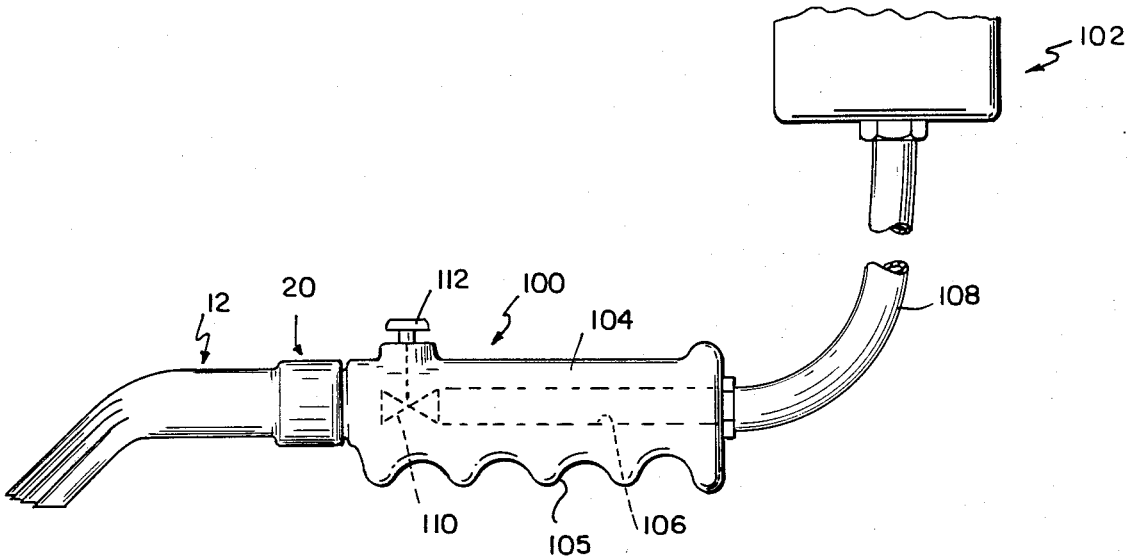
Figure 5:
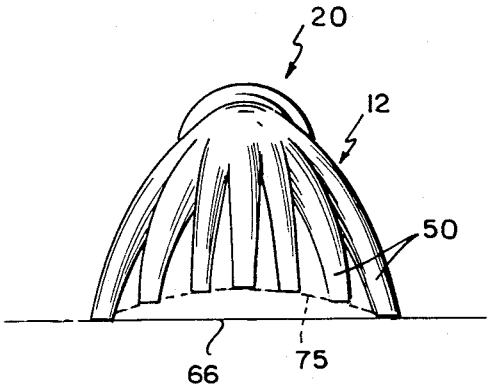
Figure 4:
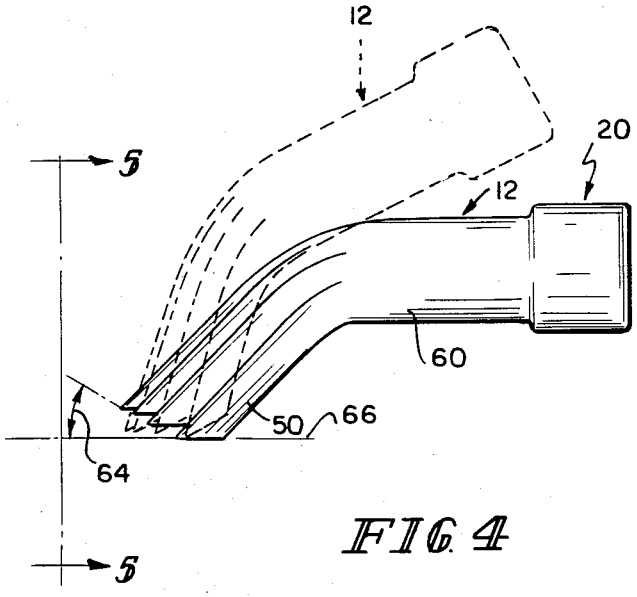

FIG. 2*a* is an enlarged sectional view of the portion of the dispenser shown in FIG. 2;

FIG. 3 is an enlarged fragmentary view of one of the teeth of the dispenser shown in FIGS. 1 and 2;

FIG. 4 is an illustration of the relationship between the head of the dispenser and the surface onto which fluid is being dispensed;

FIG. 5 is an illustration of the relationship of the teeth when viewed along the surface onto which the fluid is being applied, taken generally along lines 5—5 in FIG. 4;

FIG. 6 is a side elevational view of another dispenser embodying the present invention; and FIG. 7 is a partly fragmentary side elevational view of another dispenser embodying the present invention.

A dispenser 10 embodying the present invention is shown in FIGS. 1–5. The dispenser 10 is particularly adapted for dispensing medication or the like onto animals; however, it will be appreciated that the dispenser may be used in other applications without departing from the scope of the present invention.

The dispenser 10 includes a head 12, a container 14 with medication or other fluid 16, and means 20 for removably coupling the head 12 to the container 14. In the illustrative embodiment, the container is manufactured from a chemically resistant, clear, thin-walled vinyl for maximum flexiblity to permit the medication 16 to be applied by squeezing the container 14. The container 14 also has graduations 18 for measuring predetermined amounts of medication and water or other material to be mixed with the medication to dilute it prior to application, if necessary. The amount of medication typically is determined by the weight of the animal onto which the medication is being applied. Further, various size heads 12 may be coupled to the container 14 for different size animals.

The means 20 for coupling the head 12 to the container 14 includes threads 22 (FIG. 2) on the head 12 and mating threads (not shown) on the container 14. Thus, when the head 12 is coupled to the container 14, medication is permitted to flow from the container to the head. The head 12 can be removed from the container to permit recharging or replacement of the container. Further, as will be discussed later, the removable coupling 20 facilitates use of the head 12 with other types of containers and also makes various heads interchangeable with the container 14. These features increase the overall versatility of a dispenser embodying the present invention.

The dispenser 10 further includes means 30 providing removable orifices for selectively regulating flow of medication or the like from the container 14 through the head 12. The orifice-providing means 30 is best shown in FIGS. 2 and 2*a*, and includes a somewhat cup-shaped member 32 having means defining an orifice 34 and a nipple 36 surrounding the orifice 34. The cup-shaped member 32 has a larger opening 38 opposite to the orifice 34 which opens into the head 12 and is generally circular. The peripheral lip of the cup-shaped member 32 provides a skirt or flange 39 for engaging the threads 22 on the head 12. Thus, the cup-shaped member 32 may be removed for periodic cleaning by screwing it from threads 22. It will be appreciated that the diameter of opening 38 may vary, depending upon the size of the head 12, and that the size of the head will be determined by the size of the animal onto which the medication is being applied.

The orifice-providing means 30 further includes a plurality of individual openings 40 in the head 12. Individual orifice inserts 42 are removably received in the openings 40 to control the rate of flow of the material. Each orifice insert 42 is removable for cleaning or replacement. In one embodiment, the orifice inserts 42 are joined together by means 43 to facilitate their insertion and removal as a unit. The number of openings 40 and orifice inserts 42 will be the same as the number of teeth 50 associated with the head 12. Further, orifice inserts 42 of different sizes are available to provide different flow rates of the same material.

A flexible outlet or discharge tube 44 has one end coupled to the nipple 36 surrounding the orifice 34. The tube 44 extends into the container 14 and is provided at its other end with a weight 48 (FIG. 1). Weight 48 is a spherical bob which holds the end of the tube 44 below the surface of the medication 16 and further prevents the tube 44 from lying in corners or directly on the surface of the container so that sediments are not drawn through the tube 44. The interior 46 of the orifice-providing means 30 serves as an area for collection of sediments which may get drawn through the tube 44 for the container 14. As shown in FIG. 2*a*, sediments collect between the orifice inserts 42 in area 46.

Teeth 50 include channels 52 for the passage of medication 16 from the container 14 onto the animal. The head 12 includes means 53 providing separate passageways between the container 14 and the channels 52. The segregated passageways 53 and orifice inserts 42 provide separate channeling and control of material through each individual tooth 50. As best shown in FIG. 3, the distal end 54 of each tooth 50 is flat. Each channel is generally rectangular in section transverse to the longitudinal extent of the teeth 50. Each channel 52 has a length dimension 55 extending generally in the direction of motion of the dispenser 10 and a width dimension 56 extending generally transverse to the direction of motion of the dispenser 10. As seen in FIG. 3, the length dimension 55 is substantially greater than the width dimension 56. The distal ends 54 of the teeth 50 have leading edges 58 for assisting movement of the teeth 50 through the fur or hair of an animal. The ends 54 also have trailing edges 59 which, in the illustrative embodiment, are rounded.

The head 12 includes a surface 60 which is generally parallel to the surface 66 of the animal, as shown in FIGS. 4 and 5. Teeth 50 extend from the head 12 downward at an oblique angle 62 (FIG. 1) to the surface 60. In the illustrated embodiment, this angle 62 is 45°. As shown in FIG. 2, each tooth 50 is also flared outward from its attachment to head 12 toward its distal end 54.

The teeth 50 form a set. In the illustrative embodiment, there are seven teeth 50 in the set. Heads 12 are available which have more or less than seven teeth 50. The free distal ends 54 of the teeth 50 form a somewhat inverted-V or inverted-U configuration when viewed from perpendicular to the surface 66 of the animal, as best illustrated at 69 in FIG. 3. Further, as best seen in FIG. 5, the distal ends 54 of the teeth are contoured with the shorter teeth being toward the center of the set and the longer teeth being toward the ends of the set when viewed generally along the surface 66. Thus, the distal ends 54 of the teeth form an oblique angle 64 to the surface 66, as shown in FIGS. 1 and 4. The teeth 50 are formed somewhat in arc 69 when viewed from the bottom of the head 12 such that an oblique angle 68 exists between an imaginary line 71 from the tooth 50 at the center to a tooth 50 at the end of the set with respect to the longitudinal axis 73 of the head 12. Angles 64 and 68 may vary for use of dispenser 10 with different animals, although angles 64 and 68 will be oblique.

The shape and angular disposition of teeth 50 provide greater contact between the distal ends 54 of the teeth 50 and the animal surface 66. These features of the teeth 50 are particularly adapted for uneven curvatures in the surface 66 of the animal. As shown in phantom in FIG. 4, by tilting head 12 forward, all distal ends 54 of teeth 50 can contact a flat surface 66 of the animal. By holding the head 12 in a manner such that surface 60 is generally parallel to the animal surface, the distal ends 54 are adapted for curvatures on surface 66, as illustrated by the arc 75 of FIG. 5, joining the distal ends 54 of teeth 50 when viewed in the direction of head movement.

Other dispensers embodying the present invention are shown in FIGS. 6 and 7. In both illustrative embodiments of the dispenser 100 and 120, a head 12 having the features described above is employed. Thus, the same reference numerals have been applied to the head 12 in FIGS. 6 and 7.

A dispenser 100 having a gravity feed container 102 is shown in FIG. 6. The dispenser 100 includes a handle 104 providing a grip 105 for holding the dispenser 100. Handle 104 also includes means defining a passageway 106 therethrough. The passageway 106 in handle 104 is coupled to the container or tank 102 by a flexible tube 108. Premixed medication flows through passage 106 and handle 104 at a rate adjustable by a hand-manipulable valve 110 in passageway 106. Valve 110 is manipulated by a control member 112 which can be thumb-depressed by a person holding the handle 104. Thus, flow of medication through dispenser 100 can be initiated, regulated, and halted using valve 110. Valve 110 may be any conventional valve. Further, medication in container 102 may be fed through tube 108 by gravity, or the container 102 may be pressurized so that the medication is supplied under pressure through tube 108.

Another dispenser 120 embodying the present invention is shown in FIG. 7. Dispenser 120 introduces the medication into a stream of liquid such as water at a controlled rate. The dispenser 120 includes a handle 124 providing a grip 125. Handle 124 includes means defining a first passageway 126 therethrough for water to be mixed with the medication and means for defining a second passageway 128 therethrough for the medication. The flow of water and medication is controlled by a hand-manipulable valve 130. Valve 130 is operable by a control 132 for selectively initiating, regulating, and halting the flows of water and medication through passageways 126 and 128. Means for coupling the handle 124 to a water supply (not shown) includes threads 140 in passageway 126 and mating threads 144 on a flexible tube member 142 which is in turn connected to the water supply. Medication is retained in a container 150. Container 150 is coupled to handle 124 by threads 152. Means for defining the second passageway 128 includes a tubular member which extends downward from handle 124 into the container 150. In operation, water discharged through passageway 126 passes by the opening of passageway 128 into passageway 126 and draws medication from container 150. The greater the volume of water through passage 126, the more medication is dispensed. Thus, the ratio or mixture of medication and water remains relatively constant.

What is claimed is:

1. A dispenser for dispensing medication or the like onto animals comprising a head, a medication container, means for removably coupling the head to the container to permit flow of medication or the like from the container to the head when the container is coupled to the head and to permit recharging or replacement of the container when it is removed from the head, means providing a removable orifice having therein an inner surface around an interior fluid chamber for selectively regulating flow of medication or the like from the container through the head via the fluid chamber, a plurality of teeth extending from the head defining channels for the passage of medication or the like onto the animal, and means for coupling the fluid chamber to the channels comprising means defining a plurality of separate passageways between the fluid chamber and the channels, the orifice-providing means comprising orifice inserts removably received in the passageways to regulate the flow of medication through each channel separately, each insert having an outer surface acting in conjunction with the inner surface to provide means for collecting sediment of the like.

2. The apparatus of claim 1 wherein the means removably coupling the head to the container comprises means providing threads on the head and the orifice-providing means further comprises a generally cup-shaped member having an open end, means for engaging the threads on the head to attach the cup-shaped member thereto so that it opens facing the passageways, and means defining an orifice in a surface of the cup-shaped member opposite the open end.

3. The apparatus of claim 2 wherein the means for engaging the threads on the head comprises a generally radially extending skirt or flange on the periphery of the cup-shaped member and the means defining the orifice further comprises a nipple surrounding the orifice.

4. The apparatus of claim 3 and further comprising a length of flexible tube and means for coupling the flexible tube to the nipple.

5. The apparatus of claim 4 wherein the end of the length of flexible tube opposite the end coupled to the nipple includes a weight for maintaining the opposite end beneath the level of the medication or the like in the container.

6. The apparatus of claim 5 wherein the weight comprises a generally spherical bob on the opposite end of the tube to reduce the likelihood of the opposite end of the tube picking up sediment from the container.

7. The dispenser of claim 6 wherein the container is a flexible bottle, squeezing of the bottle forcing medication or the like through the channels and onto the animal.

8. The apparatus of claim 1 wherein the orifice-providing means further includes a generally cup-shaped member, the means for engaging the threads on the head comprising a generally radially extending skirt or flange on the lip of the cup-shaped member, and means defining an orifice in a surface of the cup-shaped member opposite the skirt or flange.

9. The apparatus of claim 8 wherein the means defining the orifice further comprises a nipple surrounding the orifice.

10. The dispenser of claim 1 and further comprising a handle, means for coupling the container to the handle, means for coupling the handle to the head, and means for defining a passageway through the handle to the head, and means for defining a passageway through the handle for coupling the container to the head.

11. The dispenser of claim 10 wherein the handle comprises a hand-manipulable valve for selectively initiating and halting the flow of medication or the like through the passageway.

12. The apparatus of claim 1 wherein the container is a gravity-feed tank.

13. The apparatus of claim 12 wherein the means for coupling the head to the container is a length of tubing.

14. The apparatus of claim 1 wherein the container is a pressurizable tank.

15. The apparatus of claim 14 wherein the means for coupling the head to the container is a length of tubing.

16. The apparatus of claim 1 wherein the teeth include ridged leading edge regions assisting to ease movement of the head through the fur of an animal.

17. The apparatus of claim 1 wherein the channels are generally rectangular in section transverse to the longitudinal extent of the teeth, with each channel having a length dimension extending generally in the direction of motion of the tooth and a width dimension extending generally transverse to the direction of motion of the tooth, the length dimension being substantially greater than the width dimension.

18. The apparatus of claim 1 wherein the head includes a surface which is generally parallel to the surface of the animal across which the head is drawn in use, and the teeth extend from the head at an oblique angle to the surface.

19. The apparatus of claim 18 wherein the angle is about 45°.

20. The apparatus of claim 19 wherein the teeth form a set with the free ends of the teeth of the set forming a somewhat inverted-V or inverted-U configuration when viewed from perpendicular to the surface.

21. The apparatus of claim 20 wherein the teeth set includes longer and shorter teeth, the free ends of the set being contoured with the shorter teeth being toward the center of the set and the longer teeth being toward the ends of the set when viewed generally from the direction in which the head is drawn across the surface of the animal.

22. A dispenser for dispensing medication or the like onto animals comprising a head, a medication container, a handle, means for coupling the container to the handle, means for defining a first passageway through the handle for water to be mixed with the medication or the like, means for defining a second passageway in the handle for coupling the container to the first passageway to dispense the medication or the like in the container into the stream of water in the first passageway, means for coupling the head to the handle, means for coupling a source of water to the first passageway on the handle remote from the point of attachment of the handle to the head, means providing a removable orifice having therein an inner surface around an interior fluid chamber for selectively regulating flow of medication or the like from the container through the head via the fluid chamber, the means for coupling the head to the handle including means for coupling the fluid chamber to the first and second passageways, a plurality of teeth extending from the head and defining channels for the passage of medication or the like onto the animal, and means defining a plurality of separate passageways between the fliud chamber and the channels for coupling the fluid chamber to the channels, the orifice-providing means comprising orifice inserts removably received in said plurality of separate passageways to regulate the flow of medication through each channel separately, each insert having an outer surface acting in conjunction with the inner surface to provide means for collecting sediment or the like.

23. The apparatus of claim 22 wherein the handle further comprises a hand-manipulable valve for selectively initiating and halting the flows of water and medication or the like from the first and second passageways, respectively.

24. The apparatus of claim 23 wherein the means for coupling the container to the handle comprises means providing mating threads on the container and handle and means for sealing the container and handle in threaded mating engagement.

* * * * *

UNITED STATES PATENT AND TRADEMARK OFFICE

CERTIFICATE OF CORRECTION

PATENT NO. : 4,495,958

DATED : January 29, 1985

INVENTOR(S) : Malcholm O. Roeder

It is certified that error appears in the above-identified patent and that said Letters Patent is hereby corrected as shown below:

In column 5, line 34, delete "of" and insert --or-- therefor.

In column 5, line 35, after the word "means" insert --for--.

In column 6, line 10, delete "to the".

In column 6, delete line 11.

In column 6, line 12, delete "handle".

In column 7, line 8, delete "fliud" and insert --fluid-- therefor.

Signed and Sealed this

*Twenty-first* Day of *May 1985*

[SEAL]

*Attest:*

DONALD J. QUIGG

*Attesting Officer* *Acting Commissioner of Patents and Trademarks*